US010480272B2

(12) United States Patent
Nguyen

(10) Patent No.: US 10,480,272 B2
(45) Date of Patent: Nov. 19, 2019

(54) ISOLATION FLANGE ASSEMBLY

(71) Applicant: CAMERON INTERNATIONAL CORPORATION, Houston, TX (US)

(72) Inventor: Dennis P. Nguyen, Pearland, TX (US)

(73) Assignee: Cameron International Corporation, Houston, TX (US)

( * ) Notice: Subject to any disclaimer, the term of this patent is extended or adjusted under 35 U.S.C. 154(b) by 455 days.

(21) Appl. No.: 15/205,557

(22) Filed: Jul. 8, 2016

(65) Prior Publication Data

US 2018/0010408 A1 Jan. 11, 2018

(51) Int. Cl.
*E21B 33/03* (2006.01)
*E21B 33/038* (2006.01)
*E21B 33/00* (2006.01)

(52) U.S. Cl.
CPC ..... *E21B 33/03* (2013.01); *E21B 33/038* (2013.01); *E21B 2033/005* (2013.01)

(58) Field of Classification Search
CPC ..... E21B 33/03; E21B 33/038
See application file for complete search history.

(56) References Cited

U.S. PATENT DOCUMENTS

2005/0242519 A1 11/2005 Koleilat et al.
2010/0170679 A1* 7/2010 Borak, Jr. ..... E21B 33/04 166/379
2010/0206545 A1* 8/2010 Nguyen ..... E21B 33/038 166/88.4
2012/0067597 A1* 3/2012 Lang ..... E21B 33/04 166/387
2012/0285676 A1 11/2012 Shaw
2013/0168104 A1 7/2013 Sinnott et al.
2015/0345243 A1 12/2015 Christie et al.

FOREIGN PATENT DOCUMENTS

WO 2016089612 A1 6/2016

OTHER PUBLICATIONS

International Search Report and Written Opinion dated Sep. 28, 2017, for Application No. PCT/US2017/041143.
Cameron "Standard 5,000 to 10,000 PSI Exit Block Installation Procedure," Surface Proposals Publication, RP-000611 Rev 02, pp. 1 to 4.

* cited by examiner

*Primary Examiner* — Robert E Fuller
(74) *Attorney, Agent, or Firm* — Conley Rose, P.C.

(57) ABSTRACT

An isolation flange assembly including a body including a receptacle disposed therein, and a first seal assembly disposed in the receptacle of the body, wherein the first seal assembly is configured to sealingly engage an inner surface of the receptacle of the body and an outer surface of a tubular member extending into the receptacle of the body, wherein the first seal assembly includes an annular radially outer seal, and an annular radially inner seal in engagement with the outer seal.

8 Claims, 5 Drawing Sheets

ISOLATION FLANGE ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

Hydrocarbon drilling and production systems require various components to access and extract hydrocarbons from subterranean earthen formations. Such systems generally include a wellhead assembly through which the hydrocarbons, such as oil and natural gas, are extracted. The wellhead assembly may include a variety of components, such as valves, fluid control lines, controls, casings, hangers, and the like to control drilling and/or extraction operations. In some operations, hangers, such as tubing or casing hangers, may be used to suspend strings (e.g., piping for various fluid flows into and out of the well) in the well. Such hangers are disposed or received within a spool, housing, or bowl. Control lines may extend through the spools, hangers, and other components for providing fluid pressure to components of the drilling and production system, such as actuatable valves, packers, and other tools. In some applications, isolation flanges are utilized for providing external access to control lines extending into the spool, hanger, or wellhead. Given that the control line must extend through an aperture or passage in the spool to be externally accessible, at least in some applications, the isolation flange must seal the control line while also sealing the interface between the isolation flange and the passage of the spool or other component through which the control line extends.

SUMMARY

An embodiment of an isolation flange assembly comprises a body including a receptacle disposed therein, and a seal assembly disposed in the receptacle of the body, the seal assembly configured to sealingly engage an inner surface of the receptacle and an outer surface of a tubular member extending into the receptacle. In some embodiments, the seal assembly comprises an annular radially outer seal, and an annular radially inner seal in engagement with the outer seal. In some embodiments, an outer surface of the outer seal comprises a ridge extending therefrom, and an inner surface of the inner seal comprises a ridge extending therefrom. In certain embodiments, the inner seal comprises a radially expanded end and a radially reduced end, and the outer seal comprises a radially expanded end and a radially reduced end. In certain embodiments, the radially expanded end of the inner seal comprises a groove extending therein. In some embodiments, the outer seal comprises a radially inner surface disposed at an acute angle relative a longitudinal axis of the body, and the inner seal comprises a radially outer surface disposed at an acute angle relative the longitudinal axis of the body. In some embodiments, the inner surface of the outer seal and the outer surface of the inner seal are in slidable engagement. In certain embodiments, the isolation flange assembly further comprises a port extending through the body and in fluid communication with the receptacle. In certain embodiments, in response to pressurization of the port, the inner seal is urged against the outer seal.

An embodiment of a spool assembly comprises a spool comprising a receptacle disposed therein, a first seal assembly disposed in the receptacle of the spool, an isolation flange comprising a receptacle disposed therein, a second seal assembly disposed in the receptacle of the isolation flange, a tubular member extending through the receptacle of the spool and the receptacle of the isolation flange, and a port extending through the isolation flange and in fluid communication with the receptacle of the spool and the receptacle of the isolation flange. In some embodiments, the spool assembly further comprises an annular seal disposed between the isolation flange and the spool, the annular seal configured to seal an interface between the receptacle of the spool and the receptacle of the isolation flange. In some embodiments, in response to a pressurization of the port, the first seal assembly is urged apart from the second seal assembly. In certain embodiments, in response to a pressurization of a bore extending through the isolation flange and in fluid communication with the receptacle of the isolation flange, an annular radially outer seal of the second seal assembly is urged against an annular radially inner seal of the second seal assembly. In certain embodiments, in response to a pressurization of a passage extending through the spool and in fluid communication with the receptacle of the spool, an annular radially outer seal of the first seal assembly is urged against an annular radially inner seal of the first seal assembly. In some embodiments, in response to a pressurization of the port, an annular radially inner seal of the first seal assembly is urged against an annular radially outer seal of the first seal assembly. In some embodiments, an outer surface of the outer seal of the first seal assembly comprises a ridge extending therefrom, and an inner surface of the inner seal of the first seal assembly comprises a ridge extending therefrom.

An embodiment of a method for installing an isolation flange comprises disposing a first radially outer seal in a receptacle of a spool, disposing a first radially inner seal in the receptacle of the spool and in engagement with the first radially outer seal, disposing a second radially outer seal in a receptacle of an isolation flange, disposing a second radially inner seal in the receptacle of the isolation flange and in engagement with the second radially outer seal, inserting a control line into a bore of the isolation flange, and coupling the isolation flange with the spool. In some embodiments, the method further comprises pressurizing a port in fluid communication with the receptacle of the spool and the receptacle of the isolation flange. In some embodiments, pressurizing the port comprises urging the first inner seal against the first outer seal and urging the second inner seal against the second outer seal. In certain embodiments, urging the first inner seal against the first outer seal comprises sliding the first inner seal against the first outer seal.

BRIEF DESCRIPTION OF THE DRAWINGS

For a detailed description of exemplary embodiments, reference will now be made to the accompanying drawings in which.

DETAILED DESCRIPTION

Figure 1:
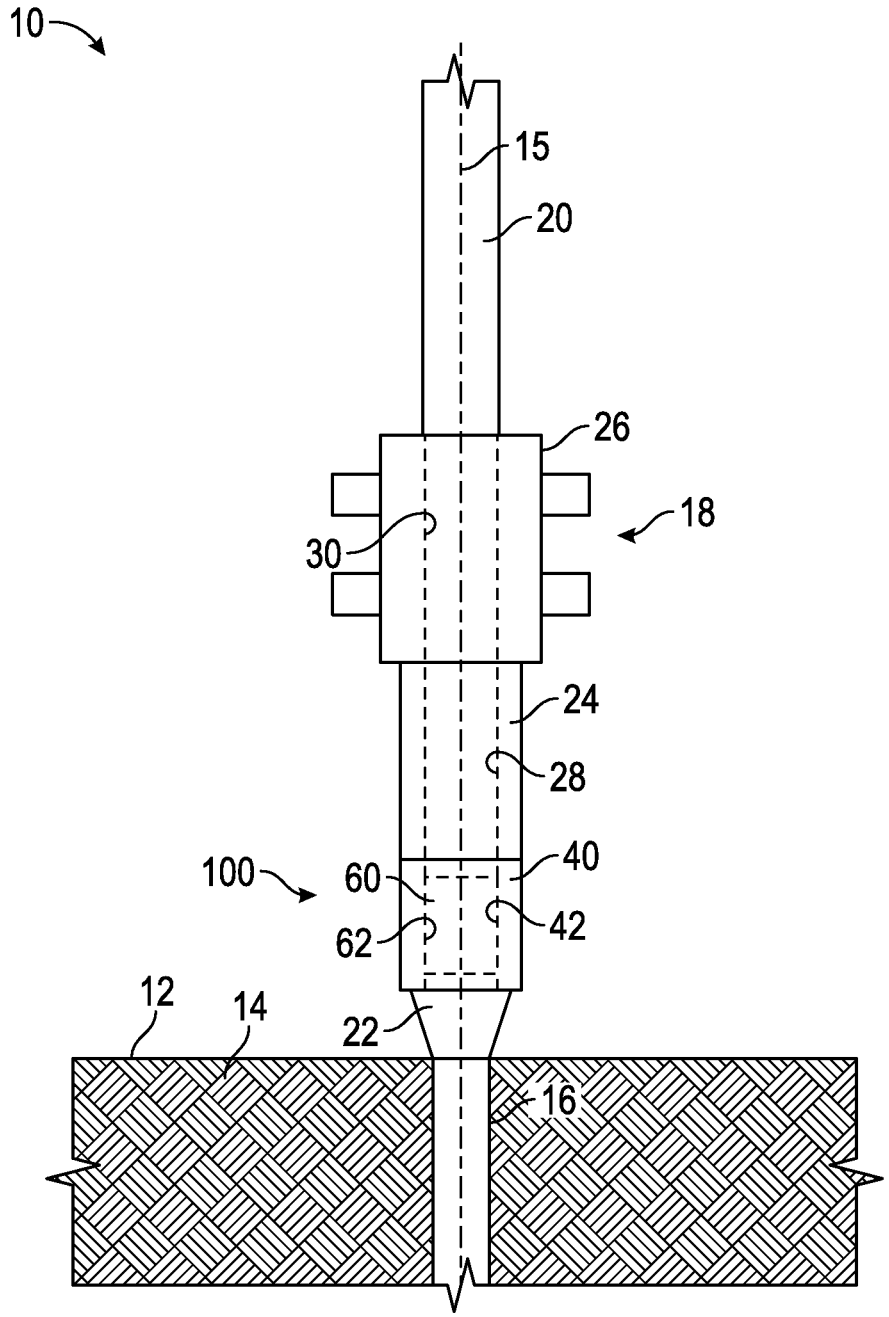
FIG. 1 is a schematic view of an embodiment of a wellhead system in accordance with principles disclosed herein.

In the drawings and description that follow, like parts are typically marked throughout the specification and drawings with the same reference numerals. The drawing figures are not necessarily to scale. Certain features of the disclosed embodiments may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, in the following discussion and in the claims, the terms "including" and "comprising" are used in an open-ended fashion, and thus should be interpreted to mean "including, but not limited to . . . ". Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

FIG. 1 is a schematic diagram showing an embodiment of a well system 10. The well system 10 can be configured to extract various minerals and natural resources, including hydrocarbons (e.g., oil and/or natural gas), or configured to inject substances into an earthen surface 12 and an earthen formation 14 via a well or wellbore 16. In some embodiments, the well system 10 is land-based, such that the surface 12 is land surface, or subsea, such that the surface 12 is the seal floor. The system 10 has a central or longitudinal axis 15 and generally includes a wellhead 18 that can receive a tool or tubular string conveyance 20. The wellhead 18 is affixed to well 16 via a wellhead connector or hub 22. The wellhead 18 typically includes multiple components that control and regulate activities and conditions associated with the well 16. For example, the wellhead 18 generally includes bodies, valves and seals that route produced fluids from the well 16, provide for regulating pressure in the well 16, and provide for the injection of substances or chemicals downhole into the well 16.

In the embodiment shown, the wellhead 18 includes a Christmas tree or tree 24, and a tubing and/or casing spool assembly 100, where spool assembly 100 generally includes a tubing and/or casing spool 40, and a tubing and/or casing hanger 60. For ease of description below, reference to "tubing" shall include casing and other tubulars associated with wellheads. Further, "spool" may also be referred to as "housing" or "receptacle." A blowout preventer (BOP) 26 may also be included, either as a part of the tree 24 or as a separate device. The BOP 26 may include a variety of valves, fittings, and controls to prevent oil, gas, or other fluid from exiting the well 16 in the event of an unintentional release of pressure or an overpressure condition. The system 10 may include other devices that are coupled to the wellhead 18, and devices that are used to assemble and control various components of the wellhead 18.

The tree 24 generally includes a variety of flow paths, bores, valves, fittings, and controls for operating the well 16. The tree 24 may provide fluid communication with the well 16. For example, the tree 24 includes a tree bore 28. The tree bore 28 provides for completion and workover procedures, such as the insertion of tools into the well 16, the injection of various substances into the well 16, and the like. Further, fluids extracted from the well 16, such as oil and natural gas, may be regulated and routed via the tree 24. As is shown in the system 10, the tree bore 28 may fluidly couple and communicate with a BOP bore 30 of the BOP 26.

The tubing spool 40 provides a base for the tree 24. The tubing spool 40 includes a tubing spool bore 42. The tubing spool bore 42 enables fluid communication between the tree bore 28 and the well 16. Thus, the bores 30, 28, and 42 may provide access to the well 16 for various completion and workover procedures. For example, components can be run down to the wellhead 18 and disposed in the tubing spool bore 42 to seal off the well 16, to inject fluids downhole, to suspend tools downhole, to retrieve tools downhole, and the like.

As one of ordinary skill in the art understands, the well 16 may contain elevated pressures. For example, the well 16 may include pressures that exceed 10,000 pounds per square inch (PSI). Accordingly, well system 10 employs various mechanisms, such as mandrels, seals, plugs and valves, to control and regulate the well 16. For example, the tubing hanger 60 is typically disposed within the wellhead 18 to secure tubing and casing suspended in the well 16, and to provide a path for hydraulic control fluid via one or more fluid control lines, chemical injections, and the like. The hanger 60 includes a hanger bore 62 that extends through the center of the hanger 60, and that is in fluid communication with the tubing spool bore 42 and the well 16.

Figure 2:
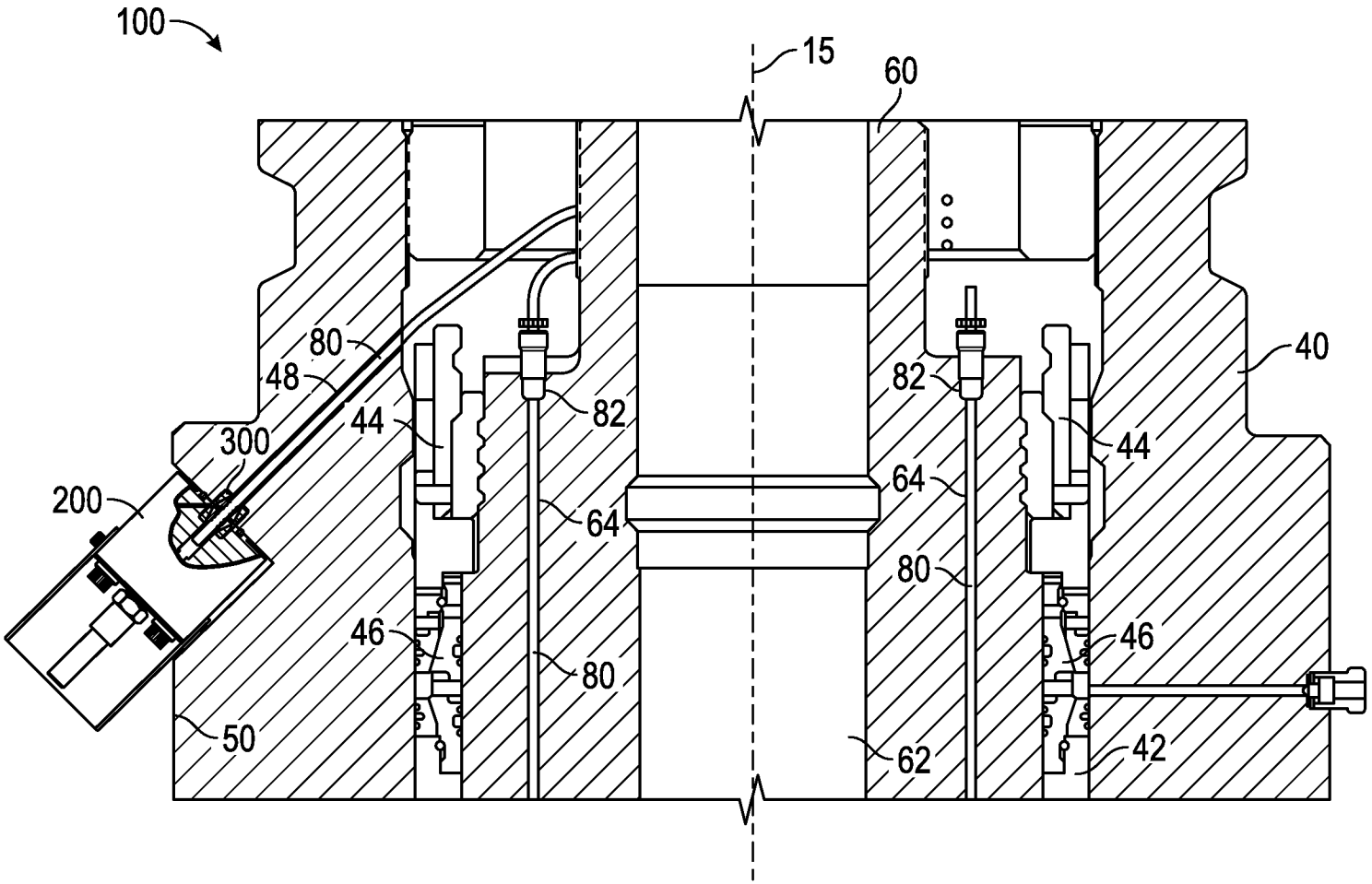
FIG. 2 is a cross-sectional view of an embodiment of a spool assembly in accordance with principles disclosed herein.

Referring now to FIG. 2, a cross-section view of the spool assembly 100 of FIG. 1 is shown. In the embodiment shown, spool 40 includes engagement members 44 for supporting hanger 60 and seal assemblies 46 for sealing an annulus formed between spool 40 and hanger 60. Spool 40 also includes a radially extending (relative longitudinal axis 15) aperture or passage 48 for receiving a tubular member or fluid control line 80 extending therethrough. Similarly, hanger 60 includes a plurality of longitudinally extending apertures or passages 64 for receiving additional control lines 80, where control lines 80 are connected via sealed connectors 82. Control lines 80 are used for selectably applying pressure to tools or components of spool assembly 100 and well system 10. In certain embodiments, control lines 80 are used to hydraulically actuate valves, packers, and other downhole tools disposed within well 16. In other embodiments, control lines 80 are used to hydraulically actuate tools disposed in wellhead 18.

In the embodiment shown, spool assembly 100 also includes an isolation flange assembly 200 and a seal assembly 300 for sealing both the control line 80 and the interface between isolation flange assembly 200 and an outer surface 50 of spool 40. Isolation flange assembly 200 provides a sealed external connection with control line 80. In this manner, control line 80 can be coupled with a component of well system 10 external spool 40 for selectably pressurizing control line 80, such as a pump and the like. Moreover, isolation flange assembly 200 is also configured to provide selective fluid communication with control line 80, and thus, may be used to seal control line 80 from external components coupled therewith. As will be discussed further herein, isolation flange assembly 200 is also configured to test the seal integrity of seal assembly 300.

Isolation flange 200 is further configured to mate or couple with the spool 40 and control line 80 while minimizing or eliminating the manipulation of control line 80 during the installation of isolation flange assembly 200. For instance, in some applications, isolation flanges require the control line 80 to be pulled or extruded through a passage in the spool (e.g., passage 48 of spool 40) in order to be fitted to the isolation flange via a compression fitting fluidically coupling the control line (e.g., control line 80) with the isolation flange. Following the making up of the compression fitting between the control line and the isolation flange, the isolation flange is fitted against and coupled with an outer surface of the spool. In some applications, while the isolation flange is fitted against the spool, the control line must be intruded or "pushed" back through the passage of the spool, resulting in excessive bending of the control line, which may damage or otherwise inhibit the operation of the control line. Thus, isolation flange assembly 200 is configured to at least eliminate the operation of intruding the control line through passage 48 of spool 40, thereby decreasing the probability of damaging control line 80 during the installation of isolation flange assembly 200.

Figure 3:
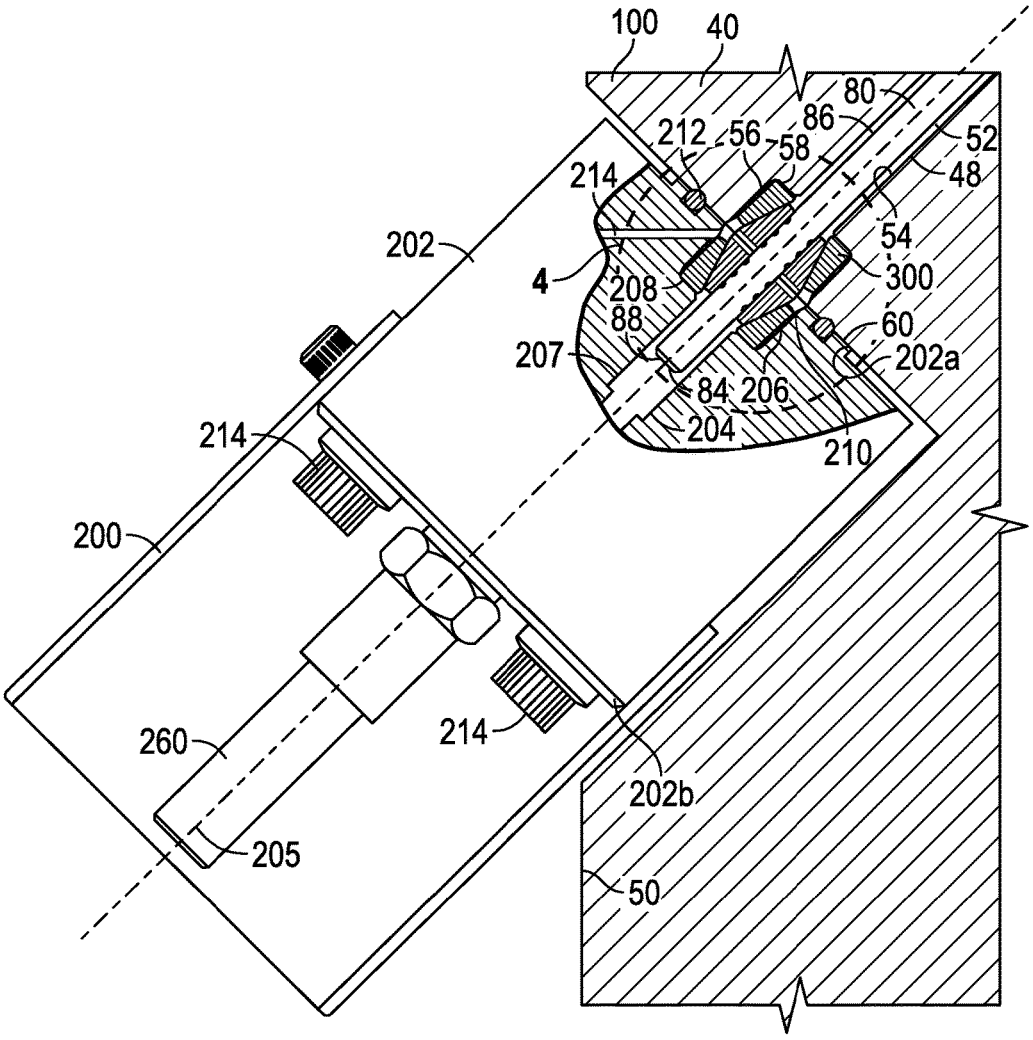
FIG. 3 is a partial cross-sectional view an embodiment of an isolation flange assembly of the spool assembly of FIG. 2 in accordance with principles disclosed herein.

Referring to FIG. 3, a partial cross-sectional view of the isolation flange assembly 200 of spool assembly 100 is shown. In the embodiment shown, isolation flange assembly 200 has a central or longitudinal axis 205 and generally includes a flange body 202, and a valve 260 coupled to body 202. Longitudinal axis 205 of isolation flange assembly 200 is disposed at an acute angle relative longitudinal axis 15 of well system 10; however, in other embodiments the longitudinal axis 205 of isolation flange assembly 200 may be disposed orthogonally respective longitudinal axis 15, or parallel with axis 15. Further, longitudinal axis 205 of isolation flange assembly 200 is disposed coaxially with a longitudinal axis of the passage 48 of spool 40. Moreover, while isolation flange assembly 200 is shown as a component of spool assembly 100, in other embodiments, isolation flange assembly 200 may be used in conjunction with other components of well system 10.

Flange body 202 has a first end 202*a*, and a second end 202*b* axially spaced from first end 202*a*. In the embodiment shown, flange body 202 includes a central bore 204 extending therethrough for receiving a terminal end 84 of control line 80, where bore 204 is defined by a generally cylindrical inner surface 207. Body 202 also includes a counterbore or seal receptacle 206 extending into body 202 from first end 202*a*, where seal receptacle 206 forms an annular shoulder 208 facing first end 202*a*. Inner surface 207 includes a frustoconical surface 210 extending partially into seal receptacle 206 from first end 202*a* of body 202. As will be discussed further herein, seal receptacle 206 of body 202 is configured to receive a portion of the seal assembly 300 for sealing against an outer surface 86 of control line 80 and the interface 60 between isolation flange assembly 200 and spool 40. In this arrangement, an annulus 52 is formed between the outer surface 86 of control line 80 and a generally cylindrical inner surface 54 defining passage 48 of spool 40. Annulus 52 extends through the interface 60 between spool 40 and isolation flange assembly 200, and thus, extends into bore 204 of body 202.

In the embodiment shown, body 202 also includes a test port 214 in fluid communication with seal receptacle 206 for testing the seal integrity of seal assembly 300, as will be discussed further herein. Body 202 further includes an annular seal assembly 212 including an annular seal and an annular seal groove extending into the first end 202*a* of body 202, where seal assembly 212 is configured to sealingly engage the outer surface 50 of spool 40. In the arrangement described above, an inner throughbore or passage 88 of control line 80 is in fluid communication with bore 204 of the body 202 of isolation flange assembly 200. Valve 260 is configured to provide selective fluid communication with the passage 88 of control line 80. Control line 80 may be fluidically coupled to a pump or other mechanism for pressurizing passage 88 of control 80 that is coupled with valve 260, thereby providing selective fluid communication between passage 88 of control line 80 and the pressurizing mechanism coupled with valve 260. In the embodiment shown, isolation flange assembly 200 is releasably coupled with spool 40 via a plurality of threaded fasteners 214 extending through apertures 202 and which are received within corresponding apertures (not shown) extending into spool 40. Although in FIGS. 2 and 3 spool assembly 100 is shown as including only a single isolation valve assembly 200, in other embodiments, spool assembly 100 may include a plurality of isolation valve assemblies 200.

Figure 4:
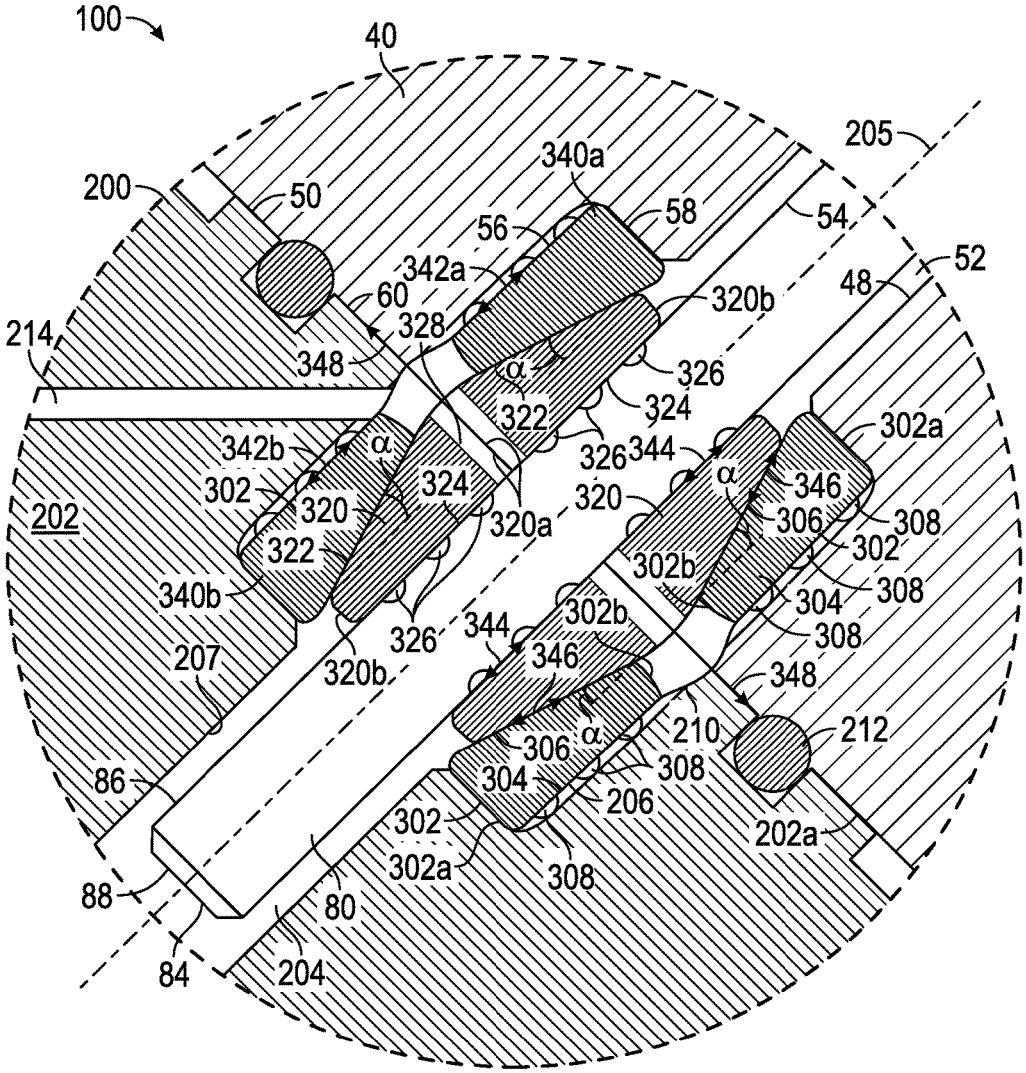
FIG. 4 is a cross-sectional view of an embodiment of a seal assembly of spool assembly of FIG. 2 in accordance with principles disclosed herein.

Referring to FIG. 4, a cross-sectional view of seal assembly 300 of spool assembly 100 and isolation flange assembly 200 is shown. In the embodiment shown, spool 40 includes a counterbore or seal receptacle 56 (also shown in FIG. 3) aligned with passage 48 and extending into spool 40 from outer surface 50. Seal receptacle 56 forms an annular shoulder 58 facing the outer surface 50 of spool 40. Seal assembly 300 is generally configured to seal control line 80 and the interface 60 formed between isolation flange assembly 200 and spool 40. Particularly, seal assembly 300 is configured to seal the annulus 52 enveloping control line 80 where control line 80 extends through the interface 60 formed between the outer surface 50 of spool 40 and the first end 202*a* of the body 202 of isolation valve assembly 200.

In the embodiment shown, seal assembly 300 generally includes a pair of outer annular seals 302 and a pair of inner annular seals 320 in sealing engagement with the corresponding outer seals 302, where outer seals 302 and inner seals 320 are each in alignment with longitudinal axis 205 of isolation flange assembly 200. Each outer seal 302 includes a first or expanded surface area end 302*a*, and a second or reduced surface area end 302*b* axially spaced from expanded end 302*a*. Each outer seal 302 also includes a radially outer surface 304 and a radially inner surface 306, where surfaces 304 and 306 each extend between ends 302*a* and 302*b*. Outer surface 304 of outer seal 302 is generally aligned with longitudinal axis 205 while inner surface 306 is disposed at an acute angle $\alpha$ relative longitudinal axis 205, giving outer seal 302 a wedge-shaped cross-section. In some embodiments, angle $\alpha$ may be zero with inner surface 306 in substantial alignment with longitudinal axis 205. Outer surface 304 comprises a plurality of annular ridges 308 or pressure concentrators extending away from outer surface 304, where ridges 308 are configured to enhance the sealing integrity between outer surface 308 and a corresponding sealing surface (e.g., inner surface 207 of bore 204 or inner surface 54 of passage 48) by increasing the surface or interface pressure between ridges 308 and the corresponding sealing surface.

In the embodiment shown, each inner seal 320 includes a first or expanded surface area end 320*a*, and a second or reduced surface area end 320*b* axially spaced from expanded end 320*a*. Each outer seal 320 also includes a radially outer surface 322 and a radially inner surface 324, where surfaces 322 and 324 each extend between ends 320*a* and 320*b*. Inner surface 324 of inner seal 320 is generally aligned with longitudinal axis 205 while outer surface 322 is disposed at acute angle α relative longitudinal axis 205, giving inner seal 320 a wedge-shaped cross-section. In this arrangement, both outer surface 322 of each inner seal 320 and the inner surface 306 of each outer seal 302 are disposed at angle α relative longitudinal axis 205, placing surfaces 322 and 306 into sliding or slidable engagement. Also, in the embodiment shown, inner surface 324 comprises a plurality of annular ridges 326 or pressure concentrators extending away from inner surface 325, where ridges 326 are similar in shape and configuration as the ridges 308 of outer seals 308. Further, each inner seal 320 includes a groove 328 extending radially along expanded end 320*a*.

Still referring to FIG. 4, seal assembly 300 is arranged into a first or outer seal assembly 340*a* disposed in seal receptacle 56 of spool 40 and a second or inner seal assembly 340*b* disposed in seal receptacle 206 of the body 202 of isolation flange assembly 200. In this arrangement, the outer seal 302 of outer seal assembly 340*a* is configured to restrict or seal against an outer potential leak path 342*a* formed between the inner surface 54 of seal receptacle 56 and the outer surface 304 of outer seal 302 via sealing engagement between the respective surfaces 54 and 304. Similarly, the outer seal 302 of inner seal assembly 340*b* is configured to restrict or seal against an outer potential leak path 342*b* formed between the inner surface 207 of seal receptacle 206 and the outer surface 304 of outer seal 302 via sealing engagement between the respective surfaces 207 and 304. In addition, the inner seals 320 of outer seal assembly 340*a* and inner seal assembly 340*b* are each configured to restrict or seal against an inner potential leak path 344 formed between the outer surface 86 of control line 80 and the inner surface 324 of the inner seal 320 of sealing assemblies 340*a* and 340*b*. Further, the outer surface 322 of inner seal 320 sealingly engages the inner surface 306 of outer annular 302 of sealing assemblies 340*a* and 340*b* to restrict or seal against intermediate potential leak paths 346 extending therebetween.

Seal assembly 300 is configured to provide increased sealing integrity against potential leak paths 342*a*, 344, and 346 in response to a fluid pressurization of passage 48 of spool 40 and bore 204 of body 202. Specifically, upon pressurization of the portion of annulus 52 in passage 48, a pressure force is applied to the expanded end 302*a* of outer seal 302 and the reduced end 320*b* of the inner seal 320 of outer seal assembly 340*a* by the fluid pressure within passage 48. Because expanded end 302*a* comprises a larger surface area than the surface area of reduced end 320*b* of inner seal 320, a larger pressure force in the direction of inner sealing assembly 340*b* is applied against expanded end 302*a* than reduced end 320*b*.

The differential forces applied to outer seal 302 and inner seal 320 longitudinally urge or forcibly impel or urge outer seal 302 towards interface 60 and inner seal assembly 340*b*. In certain embodiments, due to the abutting engagement between the inner seal 320 of seal assemblies 340*a* and 340*b*, outer seal 302 is longitudinally displaced relative inner seal 320 towards interface 60. Further, due to the angled interface provided between inner surface 306 of outer seal 302 and outer surface 322 of inner seal 320, the force applied against expanded end 302*a* of outer seal 302 is translated into a radial force between outer seal 302 and inner seal 320. Particularly, the radial force urges or forcibly impels or urges: the inner surface 306 of outer seal 302 against the outer surface 322 of inner seal 320, the outer surface 304 of outer seal 302 against the inner surface 54 of seal receptacle 56, and the inner surface 324 of inner seal 320 against the outer surface 86 of control line 80. Fluid pressure within passage 48 thereby increases the sealing integrity against potential leak paths 342*a*, 344, and 346.

Similar to the functionality described above, upon pressurization of the portion of annulus 52 disposed in bore 204 of body 202, a pressure force is applied to the expanded end 302*a* of outer seal 302 and the reduced end 320*b* of the inner seal 320 of inner seal assembly 340*b* by the fluid pressure within bore 204. In response to the pressurization, a larger pressure force in the direction of outer sealing assembly 340*a* is applied against expanded end 302*a* than reduced end 320*b*.

The differential forces applied to outer seal 302 and inner seal 320 longitudinally urge or forcibly impel outer seal 302 towards interface 60 and outer seal assembly 340*a*. In certain embodiments, due to the abutting engagement between the inner seal 320 of seal assemblies 340*a* and 340*b*, outer seal 302 is longitudinally displaced relative inner seal 320 towards interface 60. Further, as with the outer seal assembly 340*a* described above, the force applied against expanded end 302*a* of the outer seal 302 of inner seal assembly 340*b* is translated into a radial force between outer seal 302 and inner seal 320. Particularly, the radial force urges or forcibly impels: the inner surface 306 of outer seal 302 against the outer surface 322 of inner seal 320, the outer surface 304 of outer seal 302 against the inner surface 207 of seal receptacle 206, and the inner surface 324 of inner seal 320 against the outer surface 86 of control line 80. Thus, fluid pressure within bore 204 thereby increases the sealing integrity against leak paths 342*b*, 344, and 346.

Still referring to FIG. 4, test port 214 is configured to simultaneously test the sealing engagement against leak paths 342*a*, 342*b*, 344, and 346 via disposing a pressurized fluid within test port 214. Particularly, test port 214 is in fluid communication with at least a portion of each seal receptacle 206 and 56 of spool assembly 100. Upon fluidically pressurizing test port 214, pressurized fluid is communicated between the abutting ends 320*a* of the corresponding inner seals 320 via radial grooves 328 extending therein, urging apart outer seal assembly 340*a* from inner seal assembly 340*b*. In this manner, hydraulic pressure from test port 214 is communicated to each potential leak path 342*a*, 342*b*, 344, and 346, as well as a radially extending leak path 348 disposed along interface 60 and sealed via sealing assembly 212. Thus, if there is a leak or fluid communication along any of the aforementioned potential leak paths, fluid pressure within test port 214 will be lost, indicating to personnel operating spool assembly 100 that a leak has occurred along one of the potential leak paths 342*a*, 342*b*, 344, 346, and 348. However, if there is not a pressure loss following pressurization of test port 214, then personnel operating spool assembly 100 would have an indication that each potential leak path of interface 60 is sealed.

Further, test port 214 is also configured to assist in seating seal assemblies 240*a* and 240*b* such that the sealing integrity against potential leak paths 342*a*, 342*b*, 344, and 346 is maximized. As described above, fluid pressure from test port 214 is communicated between the abutting expanded ends 320*a* of the corresponding inner seals 320 assists in seating inner seals 320 and the corresponding outer seals 302 of seal assemblies 340*a* and 340*b*. Particularly, upon pressurization of test port 214, a pressure force is applied to the expanded end 320*a* of each inner seal 320 and the reduced end 302*b* of each outer seal 302 of seal assembly 300 by the fluid pressure provided by test port 214. Because the expanded end 320*a* of inner seals 320 comprise a larger surface area than the surface area of the reduced end 302*b* of outer seals 302, a larger pressure force in the direction of annular shoulder 58 (for seals 302 and 320 of outer seal assembly 340*a*) and annular shoulder 208 (for seals 302 and 320 of inner seal assembly 340*b*) is applied against expanded end 320*a* of inner seals 320 than reduced end 302*b* of outer seals 302.

The differential force applied to inner seals 320 and outer seals 302 longitudinally urge or forcibly impel inner seals 320 longitudinally away from interface 60. In certain embodiments, due to abutting engagement between the expanded ends 302*a* of outer seals 302 against annular shoulders 58 and 208, inner seals 320 are longitudinally displaced relative outer seals 302 away from interface 60. Similar to the pressure assisted sealing arrangements discussed above, due to the angled interface provided between inner surfaces 306 of outer seals 302 and outer surfaces 322 of inner seals 320, the force applied against expanded ends 320*a* of inner seals 320 is translated into a radial force between outer seals 302 and inner seals 320. Thus, fluid pressure provided by test port 214 thereby increases the sealing integrity against leak paths 342*a*, 342*b*, 344, and 346.

Figure 5:
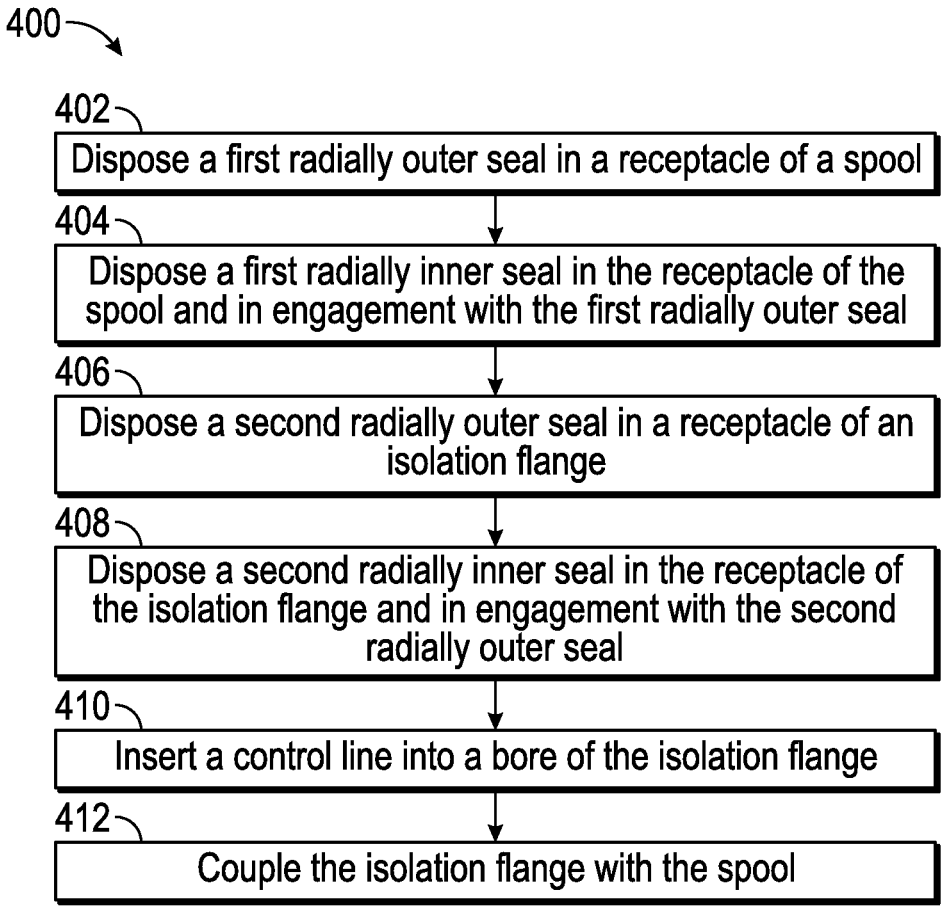
FIG. 5 is a flowchart of an embodiment of a method for installing an isolation flange in accordance with principles disclosed herein.

Referring to FIGS. 3-5, a flowchart illustrating an embodiment of a method 400 for installing an isolation flange is shown in FIG. 5. Isolation flange assembly 200, including seal assembly 300, is configured to provide for a less cumbersome installation process for installing assemblies 200 and 300 in spool assembly 100. Further, assemblies 200 and 300 are configured to reduce the manipulation (e.g., extrusion and intrusion through passage 48) of control line 80 during the installation of assemblies 200 and 300. In the embodiment shown in FIG. 5, method 400 includes at block 402 disposing a first radially outer seal in a receptacle of a spool. In certain embodiments, block 402 includes disposing the outer seal 302 of outer seal assembly 340*a* within receptacle 56 of spool 40 such that the expanded end 302*a* of outer seal 302 is disposed directly adjacent or physically engages annular shoulder 58 of receptacle 56. In some embodiments, outer surface 304 of outer seal 302 sealingly engages inner surface 54 of receptacle 56. In some embodiments, control line 80 extends through receptacle 56, where a terminal end 84 of control line 80 is disposed externally from receptacle 56.

At block 404 of method 400, a first radially inner seal is disposed in the receptacle of the spool such that the first radially inner seal is in engagement with the first radially outer seal. In certain embodiments, block 404 includes disposing the inner seal 320 of outer seal assembly 340*a* within receptacle 56 with reduced end 320*b* facing passage 48 and with outer surface 322 of inner seal 320 in slidable engagement with the inner surface 306 of outer seal 302. In certain embodiments, the inner surface 324 of inner seal 320 sealingly engages the outer surface 86 of control line 80. In some embodiments, the outer surface 322 of inner seal 320 sealingly engages the inner surface 306 of outer seal 302. At block 406 of method 400, a second radially outer seal is disposed in a receptacle of an isolation flange. In certain embodiments, block 406 comprises disposing the outer seal 302 of inner seal assembly 340*b* within seal receptacle 206 of isolation flange 200 such that the expanded end 302*a* is disposed directly adjacent or physically engages the annular shoulder 208 of receptacle 206. In some embodiments, the outer surface 304 of outer seal 302 sealingly engages the inner surface 207 of seal receptacle 206.

At block 408 of method 400, a second radially inner seal is disposed in the receptacle of the isolation flange such that the second radially inner seal is in engagement with the second radially outer seal. In certain embodiments, block 408 includes disposing the inner seal 320 of inner seal assembly 340*b* within seal receptacle 206, with reduced end 320*b* facing bore 204 and outer surface 322 of inner seal 320 in slidable engagement with the inner surface 306 of outer seal 302. In some embodiments, the outer surface 322 of inner seal 320 sealingly engages the inner surface 306 of outer seal 302. At block 410 of method 400, a control line is inserted into a bore of the isolation flange. In some embodiments, block 410 includes extending control line 80 through seal receptacle 206 of isolation flange 200 such that the terminal end 84 of control line 80 is disposed within bore 204. In certain embodiments, the inner surface 324 of inner seal 320 sealingly engages the outer surface 86 of control line 80.

At block 412 of method 400, the isolation flange is coupled with the spool. In some embodiments, block 412 includes extending threaded fasteners 214 through corresponding apertures extending through isolation flange 200, and threadably securing fasteners 214 to apertures extending into spool 40 from outer surface 50. In this manner, isolation flange 200 is threadably or releasably coupled or secured to spool 40. In some embodiments, block 412 includes providing sealing engagement at the interface 60 between spool 40 and isolation flange 200 via annular seal 212. In some embodiments, method 400 further includes testing the sealed connection formed between spool 40 and isolation flange 200 at interface 60. In certain embodiments, testing the connection formed at interface 60 includes pressurizing test port 214, which is in fluid communication with at least a portion of seal receptacles 206 and 56. In some embodiments, pressurizing test port 214 includes testing the sealing integrity of potential leak paths 342*a*, 342*b*, 344, 346, and 348 (shown in FIG. 4). In certain embodiments, pressurizing test port 214 also includes increasing the sealing integrity formed between: outer seal 302 and inner seal 320 of seal assemblies 340*a* and 340*b*, outer seal 302 of outer seal assembly 340*a* and the inner surface 54 of receptacle 56, outer seal 302 of inner seal assembly 340*b* and the inner surface 207 of receptacle 206, and inner seals 320 of seal assemblies 340*a* and 340*b* and the outer surface 86 of control line 80. Particularly, in this embodiment, sealing integrity is increased via pressurizing the groove 328 extending along the expanded end 320*a* of inner seals 320, thereby forcibly impelling each inner seal 320 in the direction of its respective outer seal 302, and thereby increasing the sealing pressure between each corresponding inner seal 320 and outer seal 302. In some embodiments, pressurizing groove 328 comprises sliding each inner seal 320 respective its corresponding outer seal 302.

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only, and are not limiting. Accordingly, the scope of protection is not limited by the description set out above, but is only limited by the claims which follow, that scope including all equivalents of the subject matter of the claims.

What is claimed is:

1. An isolation flange assembly, comprising:

a body including a receptacle disposed therein and a passage extending from the receptacle;

a first seal assembly disposed in the receptacle of the body, wherein the first seal assembly is configured to sealingly engage an inner surface of the receptacle of the body and an outer surface of a tubular member extending into the receptacle of the body, and wherein a passage of the tubular member is in fluid communication with the passage of the body; and a second seal assembly disposed in a receptacle of a spool that is coupled to the body, wherein the second seal assembly is configured to sealingly engage an inner surface of the receptacle of the spool and the outer surface of the tubular member;

wherein the first seal assembly comprises an annular radially outer seal, and an annular radially inner seal in engagement with the outer seal;

wherein the first seal assembly is configured to increase a sealing pressure between the inner seal and the outer surface of the tubular member in response to a fluid pressurization of the passage of the body.

2. The isolation flange assembly of claim 1, wherein an outer surface of the outer seal comprises a ridge extending therefrom, and an inner surface of the inner seal comprises a ridge extending therefrom.

3. The isolation flange assembly of claim 1, wherein the inner seal comprises a radially expanded end and a radially reduced end, and the outer seal comprises a radially expanded end and a radially reduced end.

4. The isolation flange assembly of claim 3, wherein the radially expanded end of the inner seal comprises a groove extending therein.

5. The isolation flange assembly of claim 1, wherein the outer seal comprises a radially inner surface disposed at an acute angle relative a longitudinal axis of the body, and the inner seal comprises a radially outer surface disposed at an acute angle relative the longitudinal axis of the body.

6. The isolation flange assembly of claim 5, wherein the inner surface of the outer seal and the outer surface of the inner seal are in slidable engagement.

7. The isolation flange assembly of claim 1, further comprising a port extending through the body and in fluid communication with the receptacle of the body.

8. The isolation flange assembly of claim 7, wherein, in response to pressurization of the port, the inner seal is urged against the outer seal.

* * * * *